United States Patent [19]

Bourrel et al.

[11] Patent Number: 4,465,494

[45] Date of Patent: Aug. 14, 1984

[54] MICROEMULSION OF WATER IN A LIQUID FUEL

[75] Inventors: Maurice Bourrel; Alain Sanchez, both of Pau; Jean-Claude Soula, Orthez, all of France

[73] Assignee: Societe Nationale Elf Aquitaine, France

[21] Appl. No.: 347,589

[22] Filed: Feb. 10, 1982

[30] Foreign Application Priority Data

Feb. 17, 1981 [FR] France ..... 81 03084

[51] Int. Cl.[3] ..... C10L 1/32

[52] U.S. Cl. ..... 44/51; 44/70; 44/71; 44/53; 44/62; 44/66; 252/356; 562/471; 260/501.15

[58] Field of Search ..... 44/51, 71, 53, 62, 66, 44/70; 252/309, 356; 562/471; 260/501.15

[56] References Cited

U.S. PATENT DOCUMENTS

| | | | |
|---|---|---|---|
| 2,110,847 | 3/1938 | Groote | 562/471 |
| 2,370,256 | 2/1945 | Niederl | 562/471 |
| 3,876,391 | 4/1975 | McCoy et al. | 44/51 |
| 4,002,435 | 1/1977 | Wenzel et al. | 44/51 |
| 4,046,519 | 9/1977 | Piotrowski | 44/51 |

FOREIGN PATENT DOCUMENTS

| | | |
|---|---|---|
| 012345 | 6/1980 | European Pat. Off. . |
| 2071297 | 4/1971 | France . |
| WO80/00921 | 11/1979 | PCT Int'l Appl. . |

*Primary Examiner*—Charles F. Warren
*Assistant Examiner*—Margaret B. Medley
*Attorney, Agent, or Firm*—Ostrolenk, Faber, Gerb & Soffen

[57] ABSTRACT

The present invention relates to a process for the preparation of a microemulsion of water or water and another additive, especially alcohol or amine, in a liquid fuel, in the presence of a surface active agent. Such microemulsions are intended to be used as fuel in an engine or a burner.

25 Claims, No Drawings

MICROEMULSION OF WATER IN A LIQUID FUEL

The present invention concerns microemulsions of water in liquid fuels or combustibles, especially hydrocarbons or mixtures of hydrocarbons with oxygenated organic compounds. It also comprises the process of their preparation as well as the use of such microemulsions as fuels, especially for engines or burners.

Microemulsion systems, constituted by hydrocarbons with a smaller proportion of water and possibly alcohols, are currently well known; numerous searches have been devoted to the preparation of this type of system, the industrial interest of which is uncontested. It is, indeed, known that a fuel containing water and alcohol, in the form of a microemulsion, offers marked advantages over fuel used alone; in engines, it can, indeed, give rise to a much reduced formation of carbon oxide, nitrogen oxides and hydrocarbons in the gases formed. It can, furthermore, improve the anti-knock properties. Thus, incorporation of water, and preferably also alcohol, to a liquid fuel, permits the increase of the combustion rate and the decrease of pollution effects. On the other hand, the addition of an alcohol, and more particularly methanol, itself a fuel, leads to an economy of hydrocarbons. It can be noted, in this respect, that fifty years ago attempts were being made with a view to the use of a "national fuel" constituted by a mixture of hydrocarbons and methanol. However, the advantages of the incorporation of water or water with alcohol, in a fuel, have only been capable of exploitation during recent years, due to surface active agents enabling the formation of a stable emulsion, i.e. a microemulsion, which prevents the separation of water during storage. Thus, the primordial factor in the preparation of the microemulsions in question is the appropriate choice of surface active agent(s) with the aim of obtaining a microemulsion of the desired stability. Numerous searches in recent years have concerned specifically this factor. Thus, for example, in U.S. Pat. No. 3,876,391, is proposed the use of surface active agents constituted by an aliphatic ester of diethylene glycol, polyoxyalkylated aliphatic esters or polyalkanolamines derivatives. U.S. Pat. No. 4,002,435 proposes the use of polyoxyethylated alkyl phenols and apparently concerns only ordinary emulsions. U.S. Pat. No. 4,046,519 describes the use of surface active agents of which the hydrophile-lipophile balance (HLB) is from 3 to 4.5, this agent being a combination of mono and diglycerides of oleic acid with bis (hydroxy-2-ethyl) stearylamine oxide. In the specification of European Patent Application 12 345, is proposed the use of polyethoxylated amides, i.e. non-ionic agents.

However, despite all the efforts made in the search for an appropriate agent that would enable the obtention of a perfectly stable microemulsion of water in a fuel, such an emulsion has not yet been satisfactorily developed and often gives rise to separation during storage, possibly at low temperature; certain of these microemulsions even lead to corrosion effects due to the nature or the quantity of the added surface active agents. The examples of microemulsions for fuels described in the literature show that the proportion of surface active agent to be used is important with respect to the water contained in the system.

The present invention offers, in this field, a considerable development by the use of an unexpected surface active compound, very different to all those that have been cited in the prior art, and which offers the advantage of supplying perfectly homogenous and stable limpid, isotropic, newtonian emulsions. Furthermore, the microemulsions according to the invention have the property of being independent of the order in which their constituents are introduced.

The process according to the invention for preparation of a microemulsion of water, possibly accompanied by another additive, especially alcohol in a liquid fuel, in the presence of a surface active agent, is characterized in that the surface active agent is an alkyl-phenoxyalkanoate of ammonium, a metal or an organic base of the type:

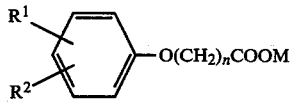

in which $R^1$ and $R^2$ identical or different are hydrogen atoms or linear or branched $C_1$ to $C_{24}$ alkyl radicals, at least one $R^1$ or $R^2$ being preferably an alkyl radical, more particularly a $C_6$ to $C_{18}$ alkyl radical.

n is usually an integer from 1 to 6 and, more often, from 1 to 2.

cation M is preferably monovalent and consists more generally in Na, K, Li, $NH_4$ or $RNH_3$ wherein R is a hydrocarbon group, possibly substituted, especially by hydroxyls.

Typical surface active agents suitable for carrying out the invention are alkyl-phenoxyacetates, the phenylic ring of which bears a relatively long alkyl radical and more particularly a $C_6$ to $C_{18}$ alkyl radical. These can be, by way of non-limitative example: sodium p-octylphenoxyacetate, potassium p-decylacetate, ammonium m-nonylacetate, sodium dioctyl 3,5-phenoxyacetate, ammonium p-laurylacetate, hexylamine p-nonylacetate, diethanolamine m-stearyl-phenoxyacetate, etc . . . However, other corresponding alkanoates are suitable, for example, alkyl-phenoxyproprionates or alkyl-phenoxybutyrates.

Given the lack of interest that the above-mentioned compounds have provoked up to now, undoubtedly due to their relatively low efficiency when compared with different surface active agents currently used in industry, it is surprising that, in the particular case of the water and/or alcohols emulsion in liquid fuels, these agents give remarkable results. It is an unexpected fact that the $(—CH_2)_nCOOM$ group contributes, in the application of the invention, to excellent results, whereas it is known in the prior art that to obtain powerful emulsions from alkylphenols it is appropriate to graft on the phenol function a more or less long polyoxyethylene chain, as indicated in U.S. Pat. No. 4,002,435 mentioned herein-above.

The surface active agents, according to the invention, can be used alone or in a mixture with other surface active substances whose activity they reinforce.

The numerous standard additives to microemulsions, which are generally known under the heading of co-surface active agents, especially alcohols and amines, are most compatible with the alkyl-phenoxyalkanoates used according to the invention. In particular, the excellent stability of the microemulsions$^X$ obtained, with alcohols as co-surface active agents, enables the obtention, according to the invention, of very stable fuels containing water and alcohols, in a large range of concentration.

X between −20° C. and +100° C. and particularly between −10° and +20° C.

The use of alcohols as co-surface active agents constitutes a preferred form of the invention; indeed, it presents a double advantage- firstly, alcohol being itself a fuel, the co-surface active agent forms part of the combustible mixture; furthermore since the fuel is a water microemulsion in a hydrocarbon, it is possible to use alcohols which are not totally dehydrated, thus constituting an economic advantage, above all when, as especially in the case of a waterethanol mixture, an azeotrope is formed which renders the total extraction of alcohol to its pure state difficult and expensive.

With the additives according to the invention, it is possible to adapt the microemulsion composition to the prevailing temperature, in which the microemulsion must remain stable, by adjusting the proportion or/and the nature of the phenoxyalkanoate used.

It should be noted that, contrary to the majority of surface active agents of the prior art used for the formation of microemulsions of liquid fuels, those of the invention contain neither sulphur nor phosphorus, thus preventing any emission of toxic products during combustion. The quantity of nitrogen contained in the microemulsion is very small when the co-surface active agent is an amine.

The process of preparation of the microemulsions according to the invention wherein the surface active agent is an alkyl-phenoxylalkanoate, can be carried out according to a method known per se, i.e. by mixture of the additives concerned with a liquid fuel. Slight stirring is sufficient to obtain a stable microemulsion. An advantage of this process lies in the fact that the additives can be mixed with the fuel in any possible order; thus, it is possible to dissolve firstly the surface active agent in water, in the co-surface-active agent, or in a mixture of the two, and to introduce the obtained solution or dispersion in the liquid fuel, under slight and brief stirring. But it is also possible to pour these different additives directly into the fuel and to stir the entire contents long enough for them to homogenize. By way of non-limitative example, the stirring of the medium can be carried out by means of a blade stirrer, rotating at about 20 to 100 tpm (peripheral speed in the range of 0.5 to 5 m/s) during 1 to 10 minutes.

The following examples are given by way of non-limitative illustration.

EXAMPLES 1 TO 9

The water microemulsions with different cosurface active agents were prepared according to the process cited herein-above, in which water previously mixed with the cosurface active agents according to the invention, was added to ordinary automobile gasoline (petroleum fraction boiling at between 20° and 200° C.). The operations were carried out with 1 liter of gasoline that was stirred for three (3) minutes after addition of the additives. The table herein-below shows the proportions of the components in percentage by total weight of the microemulsion, the surface active agent being sodium p-lauryl-phenoxyacetate.

TABLE

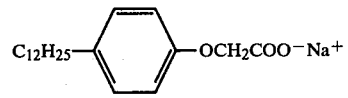

| Ex. | % of surface active agent | co surface active agent compound | % | water | gasoline |
|---|---|---|---|---|---|
| 1 | 3.5 | methanol | 1.30 | 9.5 | 85.7 |
| 2 | 9.0 | methanol | 8.60 | 1.9 | 80.5 |
| 3 | 0.50 | ethanol | 26.80 | 3.0 | 69.7 |
| 4 | 1.25 | ethanol | 8.90 | 1.0 | 88.85 |
| 5 | 1.70 | ethanol | 17.70 | 2.2 | 78.60 |
| 6 | 4.55 | isobutanol | 1.95 | 9.35 | 84.15 |
| 7 | 5.60 | isobutanol | 2.40 | 9.20 | 82.80 |
| 8 | 3.30 | ethyl-2-hexanol | 1.40 | 9.50 | 85.80 |
| 9 | 3.30 | ethyl-2-hexanol ethylated to 0.625 mole | 2.10 | 9.50 | 85.10 |
| 10 | 3.20 | benzylamine | 0.80 | 9.60 | 86.40 |

It is noted that it is possible to use proportions of water and co surface active agents within rather large limits, which is most useful in practice. All the microemulsions of Examples 1 to 10 are homogenous, limpid, isotropic, newtonian and stable at ambient temperature. Their viscosities are close to those of the gasoline used. The water or water and additive (alcohol or amine) microemulsion can contain from 1 to 10% water, 1 to 27% alcohol or amine, 1 to 10% surface active agent, and preferably 1 to 6% microemulsion in a liquid fuel.

EXAMPLES 11 to 12

Operating process is identical to that of the preceding examples, the surface active agent used being monoethanolamine p-lauryl-phenoxyacetate, i.e. that its cation was $[NH_3CH_2CH_2OH]^+$

TABLE

| Ex. | % surface active agent | co surface active agent compound | % | water | gasoline |
|---|---|---|---|---|---|
| 11 | 4.55 | isobutanol | 1.95 | 9.35 | 84.15 |
| 12 | 3.5 | ethyl-2-hexanol | 1.5 | 4.75 | 90.25 |

As with the previous examples, the emulsions of these examples are very stable and only leave very reduced carbon oxide proportions in the fuel.

EXAMPLE 13

In a preparation similar to the previous examples, was used as surface active agent sodium p-nonyl-phenoxyacetate in a proportion of 3.5% of the total quantity. With 1.3% isobutanol and 9.5% water, a perfectly stable emulsion was obtained, containing 85.7% gasoline.

EXAMPLE 14

In Example 1, ordinary automobile gasoline is replaced by light oil, known under the denomination "domestic fuel". The stable microemulsion obtained is used in a burner of a central heating installation. In the fumes, a CO content of 80 ppm was noted, whereas the combustion of domestic fuel alone, in the same burner, in the same installation, leads to the presence of 400 ppm CO in the fumes.

EXAMPLE 15

The microemulsion of Example 6 is used to feed a 1.2 l automobile engine, turning at 3,500 t/mn. The fuel consumption is thus 9.25 l per 100 km (which corresponds to a consumption of 7.9 gasoline), the emission of CO being 6 g/km and that of $NO_x$ being 0.4 g/km, whereas, in the same operating conditions, gasoline alone leads to a consumption of 9.6 l per 100 km, with a CO emission of 26 g/km and $NO_x$ of 1.6 g/km.

It is noted that the emulsion of water and ethanol in gasoline offers very marked advantages with respect to the use of gasoline alone.

Although the preceding examples are not limitative, and the invention can be applied to the preparation of microemulsions with concentrations in different constituents different from those of the present examples, a type of microemulsionated fuel is obtained which is highly practical, comprises by weight 1 to 10% water, 1 to 27% an alcohol and 1 to 6% tensio-active agent, the remainder being liquid fuel.

The invention also comprises as novel surface active agents, alkylphenoxy-alkanoates of ammonium, a metal or an organic base having the formula:

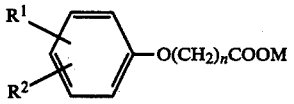

in which $R^1$, $R^2$, n and M have the meanings expressed throughout the description.

We claim:

1. In a process for the preparation of a microemulsion by mixing water and a liquid fuel in the presence of a surface active agent, the improvement which comprises said agent being an alkyl phenoxy-alkanoate of ammonium, a metal or an organic base of the formula

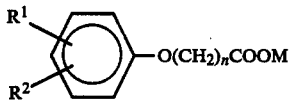

in which $R^1$ is hydrogen, $R_2$ is a linear or branched $C_6$ to $C_{18}$ alkyl radical, n is an integer from 1 to 6 and M is Na, K, Li, $NH_4$ or $RNH_3$ wherein R is a hydrocarbon or hydroxy-substituted hydrocarbon radical, in an amount of 0.5 to 10 percent, and a cosurfactant which is a $C_1$ to $C_8$ alcohol or an amine in an amount of 1 to 27 percent, and the amount of water is 1 to 10% and the balance of said microemulsion is said liquid fuel.

2. Process according to claim 1, wherein n is an integer equal to 1 or 2.

3. A process according to claim 1, wherein 1 to 27% an alcohol co-surfactant is employed with said agent.

4. A process according to claim 1, wherein said amine is a benzylamine.

5. A process according to claim 1 in which the alkyl phenoxy-alkanoate is sodium p-lauryl phenoxyacetate, monoethanolamine p-lauryl phenoxyacetate or sodium p-nonyl phenoxyacetate.

6. A process according to claim 1 wherein the amount of the surface active agent is 1 to 6%.

7. Microemulsion of water and a liquid fuel containing a surface active agent, wherein the said surface active agent is an alkyl-phenoxy-alkanoate of ammonium, a metal or an amine of the formula

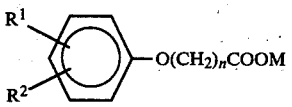

in which $R^1$ is hydrogen, $R^2$ is a linear or branched $C_6$ to $C_{18}$ alkyl radical, n is an integer from 1 to 6 and M is Na, K, Li, $NH_4$ or $RNH_3$ wherein R is a hydrocarbon or hydroxy-substituted hydrocarbon radical, in an amount of 0.5 to 10 percent, also containing 1 to 27 percent of a $C_1$ to $C_8$ alcohol or an amine, and wherein the amount of water is 1 to 10 percent and the balance of said microemulsion is said liquid fuel.

8. Microemulsion according to claim 7, wherein said microemulsion contains 1 to 6% surface active agent.

9. Microemulsion according to claim 7 wherein n is an integer equal to 1 or 2.

10. Microemulsion according to claim 7 wherein said surface active agent is sodium p-lauryl phenoxyacetate, monoethanolamine p-lauryl phenoxyacetate or sodium p-nonylphenoxyacetate.

11. In the application of a microemulsion of water or of water accompanied by an alcohol or an amine, in a liquid fuel, to combustion in an engine or a burner, wherein the microemulsion contains a surface active agent, the improvement which comprises said surface active agent being an alkyl-phenoxy-alkanoate of ammonia, a metal or an organic base of the formula

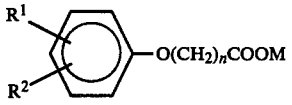

in which $R^1$ is hydrogen, $R^2$ is a linear or branched $C_6$ to $C_{18}$ alkyl radical, n is an integer from 1 to 6 and M is Na, K, Li, $NH_4$ or $RNH_3$ wherein R is a hydrocarbon or hydroxy-substituted hydrocarbon radical, in an amount of 0.5 to 10 percent, and wherein said microemulsion contains, by weight, 1 to 10% water, and 1 to 27% $C_1$ to $C_8$ alcohol or an amine and the balance of said microemulsion is said liquid fuel.

12. Application according to claim 11 wherein n is an integer equal to 1 or 2.

13. Application according to claim 11 wherein said microemulsion contains 1 to 6% surface active agent.

14. Application according to claim 11 wherein said surface active agent is sodium p-lauryl phenoxyacetate, monoethanolamine p-lauryl phenoxyacetate or sodium p-nonyl phenoxyacetate.

15. A process according to claim 4 in which the amount of benzylamine is 0.8%, the amount of water is 9.6%, the amount of said agent is 0.5 to 10%, and the balance of said microemulsion is said liquid fuel.

16. A process according to claim 1 in which the cosurfactant is methanol, ethanol, isobutanol or ethyl-2-hexanol.

17. A process according to claim 16 in which the amount of alcohol is 1.3 to 26.8%, the amount of water is 1 to 9.6%, the amount of said agent is 0.5–10% and the balance is said liquid fuel.

18. A microemulsion according to claim 7 in which the cosurfactant is benzylamine.

19. A microemulsion according to claim 18 in which the amount of benzylamine is 0.8%, the amount of water is 9.6%, the amount of said agent is 0.5 to 10% and the balance of said microemulsion is said liquid fuel.

20. A microemulsion according to claim 7 in which the cosurfactant is methanol, ethanol, isobutanol or ethyl-2-hexanol.

21. A microemulsion according to claim 20 in which the amount of alcohol is 1.3 to 26.8%, the amount of water is 1 to 9.6%, the amount of said agent is 0.5–10% and the balance is said liquid fuel.

22. Application according to claim 11 in which the cosurfactant is benzylamine.

23. Application according to claim 22 in which the amount of benzylamine is 0.8%, the amount of water is 9.6%, the amount of said agent is 0.5 to 10% and the balance of said microemulsion is said liquid fuel.

24. Application according to claim 11 in which the cosurfactant is methanol, ethanol, isobutanol or ethyl-2-hexanol.

25. Application according to claim 24 in which the amount of alcohol is 1.3 to 26.8%, the amount of water is 1 to 9.6%, the amount of said agent is 0.5–10% and the balance is said liquid fuel.

* * * * *